US010857473B1

(12) United States Patent
Liss et al.

(10) Patent No.: US 10,857,473 B1
(45) Date of Patent: Dec. 8, 2020

(54) TOY TOP

(71) Applicants: Aaron Liss, Silver Spring, MD (US); Daniel Liss, Silver Spring, MD (US)

(72) Inventors: Aaron Liss, Silver Spring, MD (US); Daniel Liss, Silver Spring, MD (US)

( * ) Notice: Subject to any disclaimer, the term of this patent is extended or adjusted under 35 U.S.C. 154(b) by 0 days.

(21) Appl. No.: 16/732,329

(22) Filed: Jan. 1, 2020

(51) Int. Cl.
*A63H 1/00* (2019.01)
*A63H 1/06* (2006.01)

(52) U.S. Cl.
CPC ..... *A63H 1/06* (2013.01)

(58) Field of Classification Search
CPC ..... A63H 1/00–32
USPC ..... 446/256–264
See application file for complete search history.

(56) References Cited

U.S. PATENT DOCUMENTS 455,943 A * 7/1891 Hill ..... A63H 1/32 446/254
617,069 A * 1/1899 Abrell ..... A63H 1/22 446/243
3,230,662 A * 1/1966 Fuchs ..... A63H 1/20 446/171
3,392,482 A * 7/1968 Nathan ..... A63H 1/00 446/261
3,502,335 A * 3/1970 Sholin ..... A63F 7/04 473/588
3,638,350 A * 2/1972 Wiggen ..... A63F 7/386 446/168
4,015,365 A * 4/1977 Stubbmann ..... A63H 1/20 446/258
4,189,862 A * 2/1980 Lopez ..... A63H 1/32 446/254
4,272,911 A * 6/1981 Strauss ..... A63H 1/32 446/459
6,969,296 B1 * 11/2005 Chen ..... A63H 1/24 446/242
10,238,983 B1 * 3/2019 Polk ..... A63H 15/06
2007/0105477 A1 * 5/2007 Wong ..... A63H 1/30 446/250
2009/0088043 A1 * 4/2009 Djan ..... A63H 1/00 446/236
2010/0124867 A1 * 5/2010 Kessler ..... A47G 33/06 446/242
2010/0255752 A1 * 10/2010 McCafferty ..... A63H 1/28 446/265

(Continued)

FOREIGN PATENT DOCUMENTS

DE 29706723 U1 * 7/1997
GB 2314444 A * 12/1997

*Primary Examiner* — Eugene L Kim
*Assistant Examiner* — Matthew B Stanczak
(74) *Attorney, Agent, or Firm* — David Fink

(57) ABSTRACT

The invention is a novel toy top which appears to defy ordinary performance. The toy top has a top portion, and a bottom portion, and is operable for being spun around with the bottom portion below the upper portion. The top portion is adapted to be rotated by an external rotational force to spin the toy top. The toy top includes means operable for enabling a change in the rotational inertia at a predetermined rate from first value to a second value lower than the first value after the toy top has started to spin, whereby the rotational spinning rate of the toy top initially reduces, and then increases due to the decrease in the rotational inertia of the toy top. Eventually, the toy top monotonically decreases its rotational spin and stops.

1 Claim, 3 Drawing Sheets

(56) References Cited

U.S. PATENT DOCUMENTS

2012/0276806 A1* 11/2012 Wu ..... A63H 1/30
446/250

* cited by examiner

TOY TOP

BACKGROUND OF THE INVENTION

The present invention relates to a toy top, particularly the simple embodiment of a toy top in which an initial external rotating force is used to "spin" the toy top around its axis.

Gyroscopic devices have been used in the form of toy tops for centuries. A typical toy top is a passive device in which an external rotational force is used to create an initial rotation force, and there is no additional external rotational force, or internal motor or power source. Some prior art toy tops use a motor or other mechanical devices to create the initial rotation force. Once the initial rotation force has been applied, the toy top rotates, and it can be positioned to stand on one end due to the gyroscopic effect. Most children and adults know that a spinning a toy top can stand on one end, but may not know that it is due to the gyroscopic effect. Ordinarily, the toy top cannot be balanced vertically on one end if the toy top is not spinning. It is obvious even to a child that the spinning makes a difference.

The gyroscopic effect is one of the many complicated concepts in physics difficult to understand on a theoretical level, but the gyroscopic effect is easy to understand in practice. The toy top continues to stand on one end while the rotational speed slows monotonically due to friction and air resistance. Eventually, the toy top slows its rotation and the gyroscopic effect can no longer maintain the toy top standing on one end. The toy top falls over. This is the normal operation of a typical toy top relying on only the initial input of rotation, and this operation is well known to many both children and adults.

The reduction in the speed of rotation of the prior art spinning toy top is always monotonic due to the friction forces, and air resistance. This is intuitively expected.

Over the centuries, toy tops have been built in numerous styles, shapes, and sizes. Sometimes, the goal of the manufacturer of the toy top is to make the toy top more interesting for children (and possibly for adults). A novel embodiment for toy tops is to create a color or light displays during the rotation of the toy top.

Regardless of the embodiment of the prior art toy tops, all toy tops share certain common attributes. Typically, each toy top has an imaginary central axis around which the toy top spins. The weight distribution of the toy top is generally symmetrical distributed with respect to the central axis, but this is not an essential requirement. An approximate symmetrical weight distribution reduces the possibility of having the toy top wobble excessively when the toy top is spinning. Of course, a toy top designer may want to have a toy top wobble as a novel effect.

The center of gravity associated with a typical prior art toy top is at or near the physical central axis of the toy top to minimize wobbling during the spinning. When the toy top is put into motion, the toy top spins around its imaginary central axis and can stands vertically on one end, or the other end, depending on the design and the choice of the operator. Some prior art toy tops are capable of having two different stable operating states for standing easily on either end of the toy top.

The prior art toy top is designed to spin around its axis in a stable manner until the rotational speed of the toy top decreases below a certain threshold level. As the rotational speed of the toy top decreases, the angular momentum of the toy top decreases. Eventually, the angular momentum of the toy top is insufficient for the gyroscopic effect to overcome the forces of gravity, and the toy top falls over and stops.

All toy tops exhibit rotational inertia when rotated. "Inertia" generally refers to a resistance to movement. Rotational inertia for an object like a toy top is based on a complicated mathematical relationship usually requiring calculus to compute. The rotational inertia is related to the mathematical sum of each point of mass of the toy top multiplied by the square of its distance from the axis of rotation. If two toy tops have the same total mass, there still could be substantial differences in the respective rotational inertial due to the difference in the mass distribution. For example, if the first toy top has more mass distributed away from the central axis than the second toy top, the first toy top will have a greater rotational inertia than the second toy top. When the same initial rotational force is applied to a toy top, the initial speed at which the toy top will spin is related to its rotational inertia. The first toy top with the greater rotational inertia will spin slower than the second toy top if both toy tops have the same initial amount of rotational force.

This is analogous to applying the same force applied to two stationary objects with different masses. The lighter stationary object with less inertia due to the lower mass will be propelled further than the heavier object. This is because the both objects will move from an initial force with a velocity proportional to force divided by mass.

If a spinning toy top with no springs or batteries is spun and proceeds to slow down as expected, but then starts to increase its rotational speed. This would be a curiosity and amusing to observe because it defies intuition, and is unexpected. The invention is a toy top which, after an initial rotational force is applied, slows rotational speed, and then increases the rotation speed without any applied external forces.

SUMMARY OF THE INVENTION

The invention relates to a novel toy top. After a predetermined initial rotational force is applied to the toy top, the toy top rotates as expected but then rotation the toy top does not follow the prior art expectation of monotonically reducing the speed of rotation of the toy top until the toy top stops.

Instead, the novel toy top slows its rotation, but then speeds up without any applied external forces, or an internal spring or motor. This process contradicts intuitive expectations, and provides entertainment for both children and adults.

In one embodiment, the toy top according to the invention has a top portion, and a bottom portion, and is operable for being spun around its axis with the bottom portion below the upper portion. The top portion is adapted to be rotated by an external rotational force to spin the toy top. Usually a stem on a toy top is simply twisted with fingers to spin the toy top. The toy top includes means operable for enabling a change in the rotational inertia from first value to a second value lower than the first value after the toy top has started to spin, whereby the rotational spinning rate of the toy top initially reduces, and then increases due to the decrease in the rotational inertia of the toy top. Eventually, the toy top monotonically decreases its rotational spin and stops.

In another embodiment, the toy top according to the invention comprises a top portion, and a bottom portion, and is operable for being spun around its axis with the bottom portion below the upper portion. The top portion is adapted to be rotated by an external rotational force. The top portion includes a section removable to provide access to a first interior compartment of the top portion. The first interior compartment of the top portion has a bottom surface generally concave up with a first opening at the bottom of the concave surface and a first opening in communication with the bottom portion so that a liquid in the first interior compartment will potentially flow down the first opening to a second interior compartment in the bottom portion. The second interior compartment is shaped so that a liquid from the first opening in the second interior compartment tends to reside near the imaginary central axis in the second interior compartment. The first interior compartment in the top portion includes a small ball which can be positioned over the first opening to inhibit the flow of the liquid down the first opening. The ball is composed of a material attracted to a magnet. The first interior compartment has a second opening in communications with the exterior of the toy top to allow air outside the toy top to enter into the first interior compartment. The second opening has a size to control the rate of flow of the liquid down the first opening at a predetermined rate when the ball is not blocking the first opening. The first interior compartment is generally closed to air entering except for the second opening.

The first interior compartment is at least partially filled with a liquid prior to spinning the toy top. The ball is positioned over the first opening to inhibit the flow of the liquid before the toy top is spun.

When the toy top is spun, centrifugal force will move the ball away from the first opening to the interior wall of the first compartment. The ball and the interior wall have magnetic properties to interact with each other so that when the ball contacts the wall, the ball is held against the wall to allow the liquid to move down the first opening uninhibited by the ball. As the liquid moves down the first opening, the interior of the upper portion must replace the liquid lost with air or the flow of the liquid will be inhibited.

Hence, the size of the second opening as well as the size of the first opening can be predetermined to control the rate of flow of the liquid down the first opening. The flow of the liquid from the upper portion to the lower portion will bring more liquid near the central axis in the second compartment, thereby reducing the inertia of the toy top, and increasing the rate of rotation of the toy top.

In yet another embodiment, the toy top according to the invention comprises a top portion, and a bottom portion, and is operable for being spun around its axis with the bottom portion below the upper portion. The top portion is adapted to be rotated by an external rotational force. The top portion includes a section removable to provide access to a first interior compartment of the top portion. The first interior compartment of the top portion has a bottom surface concave down in its central portion to retain most of the liquid in the first interior compartment to be closer to the circumference of the first interior compartment than the axis. The bottom surface is concave up around its periphery.

There is a first opening at the bottom of the concave up surface in a generally central position, and the first opening is in communication with the bottom portion so that a liquid in the first interior compartment will potentially flow down the first opening to a second interior compartment in the bottom portion. The top portion has a second opening to allow air to flow into the first interior compartment as needed to allow the liquid to flow out. The second interior compartment is shaped so that a liquid from the first opening in the second interior compartment tends to reside near the axis of the toy top in the second interior compartment. The first interior compartment in the top portion includes a ball which can be positioned over the first opening to inhibit the flow of the liquid down the first opening. The height of the concave up portion of the bottom surface distal from the wall of the first interior compartment is sufficient to inhibit the ball from moving towards the center of the bottom surface and away from the wall of the first interior surface. The first interior compartment has a second opening in communications with the exterior of the toy top to allow air outside the toy top to enter into the first interior compartment. The second opening has a size to control the flow of the liquid down the first opening at a predetermined rate when the ball is not blocking the first opening. The first interior compartment is generally closed to air entering except for the second opening.

The first interior compartment is at least partially filled with a liquid prior to spinning the toy top. The ball is positioned over the first opening to inhibit the flow of the liquid before the toy top is spun.

When the toy top is spun, centrifugal force will move the ball away from the first opening to the interior wall of the first compartment. The centrifugal forces can retain the ball against the interior wall to allow the liquid to move down through the first opening. In an alternative embodiment, the ball can have magnetic properties, and the interior wall can also have magnetic properties to retain the ball when the ball contacts the wall to allow the liquid to move down the first opening uninhibited by the ball. In a simple arrangement, the ball can be made of a material attracted to a magnet, and the wall can be covered with a material that is magnet so that the ball will be maintained at the wall through magnetic attraction. As the liquid moves down the first opening, the interior of the upper portion must replace the liquid lost with air or the flow of the liquid will be greatly inhibited.

Hence, the size of the second opening as well as the size of the first opening can be predetermined to control the rate of flow of the liquid down the first opening. The flow of the liquid from the upper portion to the lower portion will bring more liquid near the central axis in the second compartment, thereby reducing the inertia of the toy top, and increasing the rate of rotation of the toy top.

DESCRIPTION OF THE INVENTION

Figure 1:
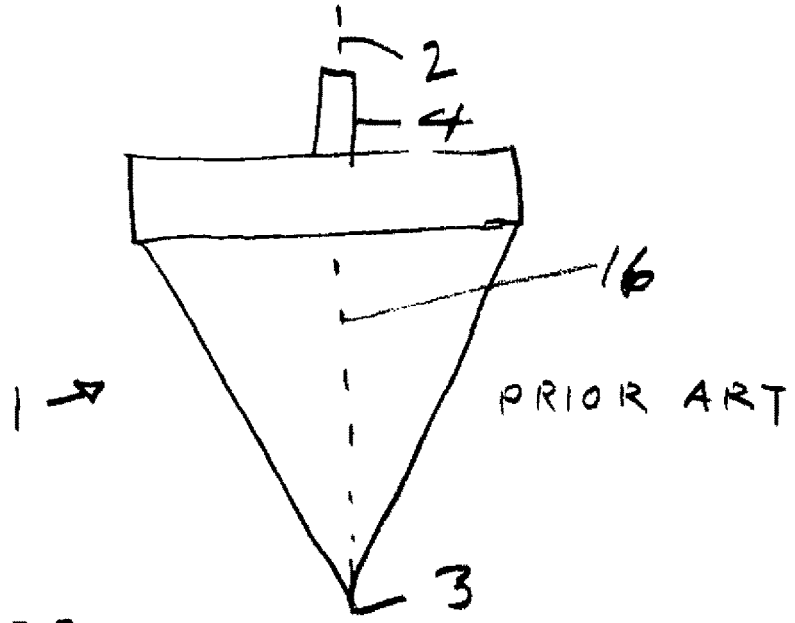
FIG. 1 is a front elevational view of a typical prior art toy top.

FIG. 1 shows a front elevational view of a typical prior art toy top 1. Toy top 1 is circularly symmetrical and has the same appearance from every side elevational view. The toy top I is operated by causing it to spin around the imaginary axis 2 (shown in a dotted line) and then placing the toy top 1 on its end 3 on a surface. The typical prior art toy top I is shaped to have much of its mass distal to the axis 2 such as shown in FIG. 1 shown. There are numerous known methods for causing the toy top 1 to spin around its axis 3. The known methods for spinning a toy top include simply using fingers on stem 4, wrapping a string around the stem 4, and pulling the string so the toy top 1 spins, or wrapping a string around the toy top 1, and pulling the string so the toy top 1 spins, or using a known mechanical device or the like to cause the toy top 1 to spin. The invention is not limited to the type of rotational force to start the toy top 1 rotating.

Prior art toy top 1 starts out at a given rotational speed depending on the applied rotational force, and toy top 1 gradually slows down due to friction, and air drag until the toy top 1 falls over. Without the use of an additional external force or an internal motor or the like, the reduction of the rotational speed of the prior art top 1 is decreasing. This reduction of rotational speed is intuitive, and always expected by children and adults.

Figure 2A:
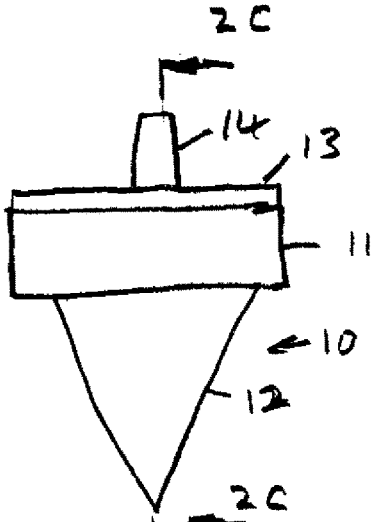
FIG. 2A is a front elevational view of a first embodiment of the toy top according to the invention.
Figure 2C:
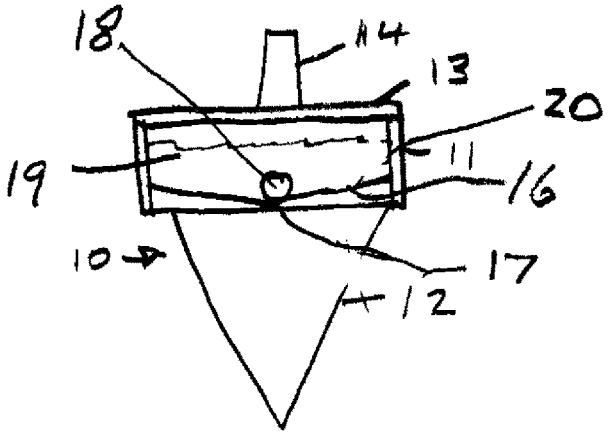
FIG. 2C is a sectional view of the toy top shown in FIG. 2A along lines 2C-2C.
Figure 2B:
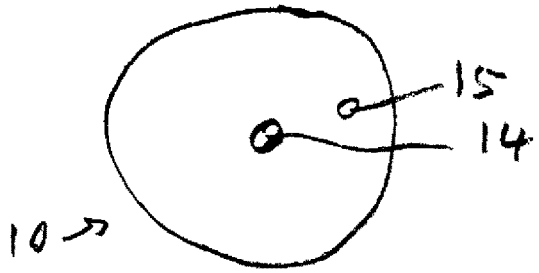
FIG. 2B is a top plan view of the toy top shown in FIG. 2A.

FIGS. 2A, 2B and 2C show toy top 10, one embodiment of the invention. The image of toy top 10 shown in FIG. 2A is the same around the toy top 10. The toy top 10 has a top portion 11, and a bottom portion 12. The top portion 11 has a removable portion 13 which can be removed to obtain access to the interior of portion 11. The prior art has many methods of making a removable portion 13 such as having removable portion 13 screw into place, or snap into place, or engage magnetically. The stem 14 is used to create the initial rotation of top 10. The top plan view in FIG. 2B shows opening 15 which can allow air to enter the top portion 11.

The sectional view in FIG. 2C of the toy top 10 taken along line 2C-2C in FIG. 2A shows the curved bottom 16 in the top portion 11 and a second opening 17 blocked by ball 18 to inhibit a liquid 19 in the top portion 11 from moving down to the interior of the bottom portion 12. The curved bottom 16 is concave up to have the liquid 19 flow towards the second opening 17 when the ball 18 is moved away.

When top 10 is rotated around its axis 16, the centrifugal forces on ball 18 will cause ball 18 to move radially to the side wall 20 of the top portion 11. Once ball 18 moves off of opening 17, the liquid 19 in the top portion 11 will tend to go down into the bottom portion 12, thereby moving mass closer to the axis of top 10. The centrifugal force due to the rotation of the toy top 10 will generally keep the ball 18 at the side wall 20 until most, if not all, of the liquid 19 in the top portion 11 moves to the bottom portion 12. This is a design that can be determined easily through trial and error. The factors are the angle of the angle of the inclined bottom portion, and the range of rotational speeds of the toy top 10 when in use.

The changes the inertia of the toy top 10 due to the liquid being added to the bottom portion 12 near the axis 2 will cause the top 10 to speed up its rotation as compared to the speed of rotation for the unchanged toy top 10. The rate of movement of the liquid 19 through the opening 17 can be controlled by the sizes of the openings 15 and 17, and designing the top portion 10 to be air tight except for opening 15. If there were no opening 15, virtually no liquid 19 would pass through opening 17 due to a low pressure being produced above the liquid as soon as some liquid 19 has passed though the opening 17. The interior diameter of the bottom portion 12 can be made relatively narrow to concentrate the liquid close to the axis of the top 10 to increase the effect of the change in inertia.

The liquid 19 can be as simple as water, or a heavier liquid such as oil. The heavier liquid such as oil will produce a larger change in the rotational speed during the operation of the toy top 10.

Figure 3A:
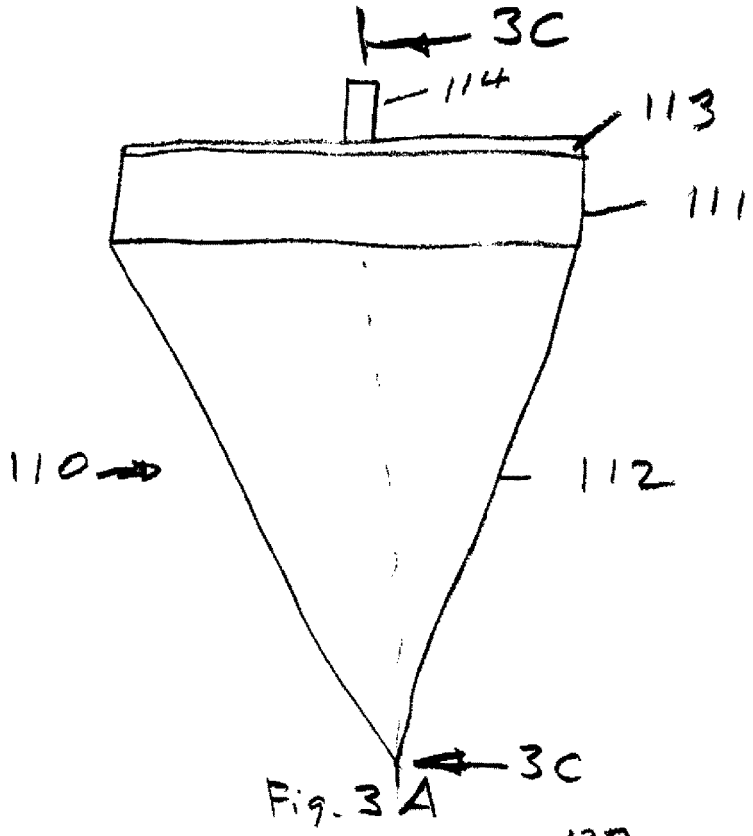
FIG. 3A is a front elevational view of a second embodiment of the toy top according to the invention.

FIGS. 3A, 3B, 3C, and 3D show another embodiment of the invention. The image of the toy top 110 shown in FIG. 3A is the same around the toy top 110. The toy top 110 appears externally similar to the toy top 10 in FIGS. 3A and 3B; however, there are internal differences, but both of the toy tops 10, 110 operated similarly.

Figure 3B:
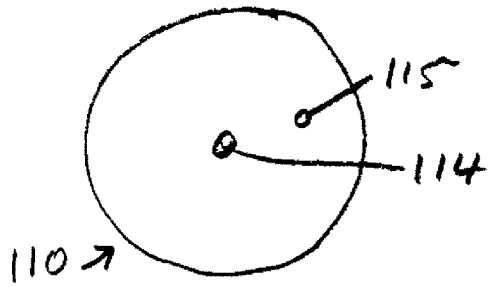
FIG. 3B is a top plan view of the toy top shown in FIG. 3A.

The toy top 110 has a top portion 111, and a bottom portion 112. The top portion 111 has a removable portion 113 which can be removed to obtain access to the interior of portion 111. The prior art has many methods of making a removable portion 113 such as having removable portion 113 screw into place, or snap into place, or engage magnetically. The stem 14 is used to create the initial rotation of top 110. The top plan view in FIG. 3B shows opening 115 which can allow air to enter the top portion 11.

Figure 3C:
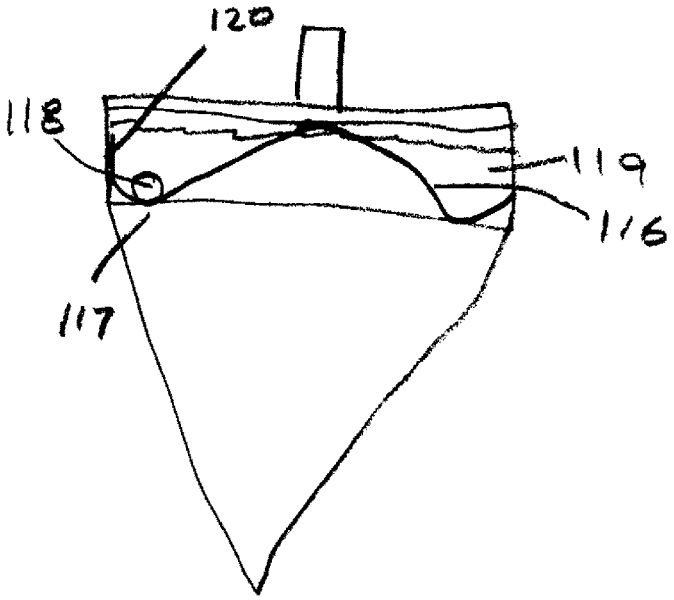
FIG. 3C is a sectional view of the toy top shown in FIG. 3A along lines 3C-3C.

The sectional view in FIG. 3C of the toy top 110 taken along line 3C-3C in FIG. 3A shows the bottom 116 in the top portion 111 and a second opening 117 blocked by ball 118 to prevent a liquid 119 in the top portion 111 from moving down to the bottom portion 12. The bottom portion 116 is concave up in most of its central portion, and concave down around the periphery of the central portion so the liquid 119 in the top portion 111 resides mainly away from the axis of the toy top 112. The concave up portion of the bottom 116 is intended to retain the ball 118 on the second opening 117 when the toy top 110 is not being spun. The size of the second opening 117 and the ball 118 can be determined experimentally to optimize the results. The size and weight of the ball 118 are not critical, but the size of the second opening 117 will greatly impact the rate of flow into the second portion 112, and the change in the rotational speed to the toy top 110 observed during the use of the toy top 110.

When toy top 110 is rotated around its axis 116, the centrifugal forces on ball 118 will cause ball 118 to move radially up the concave up portion of the bottom 116 to the side wall 120 of the toy top 112. Once ball 118 moves off of opening 117, the liquid 119 in the top portion 111 will tend to go down into the bottom portion 112, thereby moving mass to closer to the axis of toy top 110. The centrifugal force due to the rotation of the toy top 110 will generally keep the ball 118 at the side wall 120 or cause the ball 118 to move along the periphery of the bottom 116 away from the opening 117 until most, if not all, of the liquid 119 in the top portion 111 moves to the bottom portion 112.

Alternatively, the ball 118 and the side wall 120 can be selected to be magnetically attracted to each other so the ball 118 would be maintained against the side wall 120 after the ball 118 has been moved from its position on the first opening 117.

The changes in the inertia of the toy top 110 due to the liquid 119 being added to the bottom portion 112 near the axis will cause the toy top 110 to speed up its rate of rotation as compared to the speed of rotation for the toy top 110 before the movement of the liquid 119. The rate of movement of the liquid through the opening 117 can be controlled by the sizes of the openings 115 and 117, and designing the top portion 110 to be air tight except for opening 115. If there were no opening 115, virtually no liquid 119 would pass through opening 117 due to a low pressure being produced above the liquid as soon as some liquid passed though the opening 117. The interior diameter of the bottom portion 112 can be made relatively narrow to concentrate the liquid close to the axis of the top 110 to increase the effect of the change in inertia.

The liquid 119 can be as simple as water, or a heavier liquid such as oil. The heavier liquid such as oil will produce a larger change in the rotational speed during the operation of the toy top 110 as compared to water.

Figure 4A:
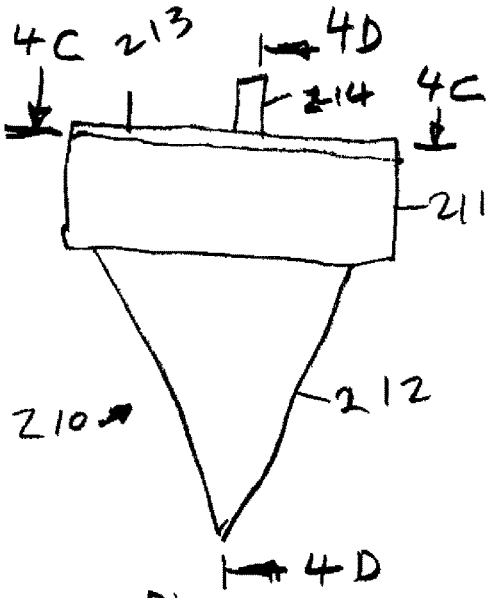
FIG. 4A is a front elevational view of a third embodiment of the toy top according to the invention.
Figure 4B:
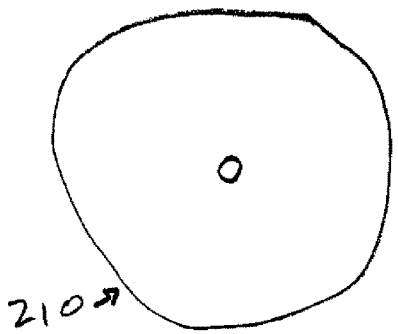
FIG. 4B is a top elevational view of the toy top shown in FIG. 4.

FIGS. 4A, 4B, 4C, and 4D show an additional embodiment of the invention. The image of the toy top 210 shown in FIG. 4A is the same around the toy top 210. The toy top 210 appears externally similar to the toy top 110 in FIGS. 3A and 3B; however, they operate differently to achieve similar results.

The toy top 210 has a top portion 211, and a bottom portion 212. The top portion 211 has a removable portion 213 which can be removed to obtain access to the interior of portion 211. The prior art has many methods of making a removable portion 213 such as having removable portion 113 screw into place, or snap into place, or engage magnetically. The stem 214 is used to create the initial rotation of top 210.

Figure 4C:
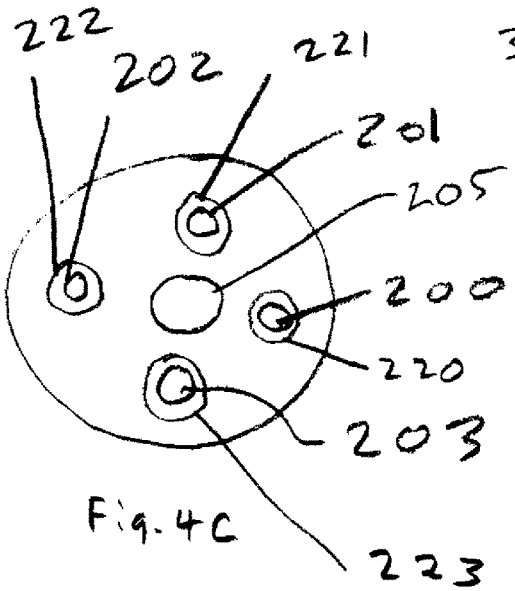
FIG. 4C is a sectional view of the toy top shown in FIG. 4A along lines 4C-4C.

The toy top 210 as shown in FIG. 4C uses heavy balls 200, 201, 202, 203 instead of a liquid to change the mass distribution within the toy top 210 to increase the rotational rate. During the use of the toy top 210, the balls 200, 201, 202, 203 move to the lower portions 212 through opening 205.

Figure 4D:
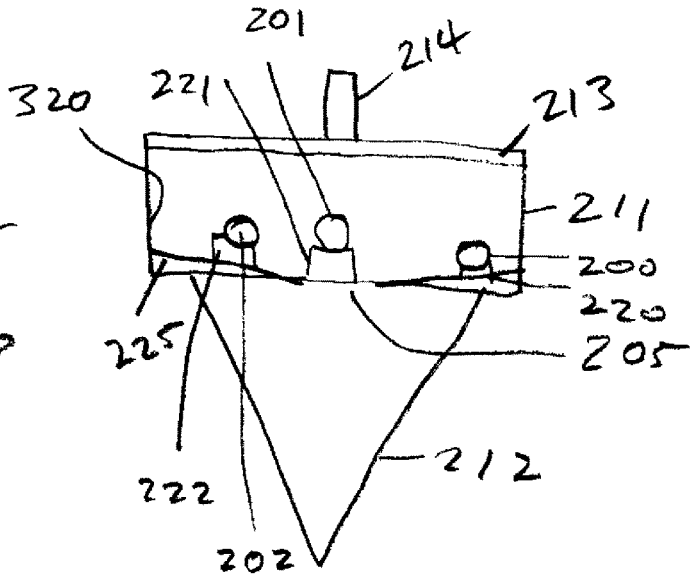
FIG. 4D is a sectional view of the toy top shown in FIG. 4A along lines 4D-4D.

FIG. 4C shows a sectional view along lines 4C-4C in FIG. 4A and FIG. 4D shows a sectional view along lines 4D-4D in FIG. 4A. The four balls 200, 201, 202, 203 are positioned on platforms 300, 301, 302, 303, respectively. Each of the platforms are on a surface 220 inclined towards an opening 217 so that when any of the balls 200, 201, 202, 203 is displaced from its platform 300, 301, 302, 303, respectively, gravity will tend to move the ball 200, 201, 202, 203 towards opening 217 and fall into the lower portion 210. The centrifugal force due to the rotation of the toy top 212 may delay the respective balls 201, 202, 203, 204; however, the platforms 300, 301, 302, 303 are preferably close to the inner wall 320 of the interior compartment and the opening 217 is large and close to the platforms 300, 301, 302, 303 so that when any of the balls 200, 201, 202, 203 fall of the respective platforms 300, 301, 302, 303, the ball fall almost immediately into the opening 205 and then the second portion 212. Preferably, all of the balls 201, 202, 203, 204 are about the same weight to simplify the construction and positioning. Each of the balls 201, 202, 203, 204 is smaller than the opening 217.

The balls 200, 201, 202, 203, 204 start out further away from the axis of the toy top 210 and after they fall into the lower portion 212 the rate of rotation of the toy top 212 increases.

The invention claimed is:

1. A toy top having a central axis, compromising:

a stem portion operable for applying a rotational force for rotating said toy top around its central axis;

said toy top having an upper interior compartment; said upper interior compartment capable of retaining a predetermined quantity of a liquid;

said toy top having a lower interior compartment; said lower interior compartment capable of receiving and retaining a portion of said liquid from said upper interior compartment;

said toy top exhibiting a lower rotational inertia when said portion of said liquid is in said lower interior compartment as compared to when all of said liquid is within said upper interior compartment;

blocking means operable for selectively inhibiting the movement of said liquid from said upper interior compartment to said lower interior compartment; said blocking means operable to inhibit the movement of said liquid from said upper interior compartment to said lower interior compartment when said toy top has its central axis vertical, and said toy top is stationary, and said blocking means operable to allow the flow of said liquid from said upper interior compartment to said lower interior compartment when the rotational rate of said toy top exceeds a predetermined rotational rate;

whereby said toy top increases its rotational speed at least temporarily due to reduction in the rotational inertia resulting from the movement of said liquid from the upper interior compartment to said lower interior compartment.

* * * * *